US009216801B2

(12) United States Patent
Barron

(10) Patent No.: US 9,216,801 B2
(45) Date of Patent: Dec. 22, 2015

(54) FLOATATION DEVICE

(71) Applicant: Paul Barron, Christchurch (NZ)

(72) Inventor: Paul Barron, Christchurch (NZ)

( * ) Notice: Subject to any disclaimer, the term of this patent is extended or adjusted under 35 U.S.C. 154(b) by 63 days.

(21) Appl. No.: 13/931,713

(22) Filed: Jun. 28, 2013

(65) Prior Publication Data

US 2014/0024272 A1 Jan. 23, 2014

(30) Foreign Application Priority Data

Jul. 23, 2012 (NZ) ..... 601398

(51) Int. Cl.
*B63B 35/81* (2006.01)
*B63B 35/79* (2006.01)

(52) U.S. Cl.
CPC ..... *B63B 35/7906* (2013.01); *B63B 35/7909* (2013.01)

(58) Field of Classification Search
USPC ..... 441/74; 114/357
IPC ..... B63B 35/7906
See application file for complete search history.

(56) References Cited

U.S. PATENT DOCUMENTS

| | | | | |
|---|---|---|---|---|
| 4,753,836 | A | 6/1988 | Mizell | |
| 5,934,961 | A | 8/1999 | Mehrmann et al. | |
| 6,071,160 | A | 6/2000 | Chen | |
| 6,402,578 | B1 | 6/2002 | Zappitelli | |
| 7,246,568 | B1 | 7/2007 | Cheung | |
| 7,507,133 | B2 | 3/2009 | Cheung | |
| 7,963,815 | B2 * | 6/2011 | Mead | 441/74 |
| 2007/0010145 | A1 * | 1/2007 | Mehiel | 441/74 |
| 2008/0210137 | A1 | 9/2008 | Cox | |
| 2010/0240271 | A1 * | 9/2010 | Mann | 441/74 |
| 2011/0023762 | A1 | 2/2011 | Chen | |

OTHER PUBLICATIONS

International Preliminary Report on Patentability for Appl. No. PCT/NZ2013/000126, dated Jun. 3, 2014.

* cited by examiner

*Primary Examiner* — Stephen Avila
(74) *Attorney, Agent, or Firm* — Foley & Lardner LLP

(57) ABSTRACT

Described herein are floatation devices, surfboards, surfboard blanks and methods of manufacture. The board or device design is altered by removal of a traditional stringer or stringers and instead form a composite of different foams to produce a board or device with improved strength and durability along with similar or even better board dynamics.

36 Claims, 2 Drawing Sheets

FLOATATION DEVICE

CROSS-REFERENCE TO RELATED APPLICATION

This application claims priority to New Zealand Application No. 601398 filed on Jul. 23, 2012, entitled IMPROVED FLOTATION DEVICE, the entire content of which are hereby incorporated by reference in its entirety.

BACKGROUND

1. Field

Described herein is an improved floatation device. The device such as a surfboard does not utilise a stringer as traditionally used and instead used a low density foam layer as the core of the device.

2. Description of the Related Art

Flotation devices such as surfboards have been made more many years, the design of the board gradually altering as new materials and techniques become available.

US publication number 2010/0240271 provides detailed synopsis of the history of surfboard manufacture and in the interests of brevity, this publication is referred to and incorporated herein.

To summarise, surfboards are traditionally manufactured from a blank comprising two polyurethane (PU) foam sections and a wooden or foam 'stringer' extending from the nose of the board to the tail which gives structure to the board. PU foam alone lacks the structural integrity required as it is bendy up to a point and then fails dramatically. A stringer is traditionally added in order to reduce the board flex and thereby minimise board breakage and improve board performance. Stringer designs typically represent the best compromise between strength and board dynamics. Despite use of a stringer or stringers, board breakage is still a common occurrence, particularly in larger waves or when the board strikes a hard feature such as rocks or coral reef.

Methods to address board breakage yet still maintain the desired flex and performance of a board have varied.

US2010/0240271 noted above illustrates one method being to incorporate a carbon fibre layer or layers within the board. This publication also teaches about the need to vary the curvature of the carbon fibre core relative to the curvature of the top surface. The publication also still shows and uses a stringer or stringers and does not necessarily do away with the need for such stiffening parts.

A further problem with traditional stringer designs is that the board top and bottom surfaces (top or deck and base or underside or waterside) have the stringer flush or extending from the surrounding foam. This makes shaping the board difficult as two varying materials need to be shaped rather than one continuous smooth surface.

In the marine boat building industry, composite designers determined early on that sandwiching a low-density, lightweight core material between thin face sheets can dramatically increase a laminate's stiffness with little added weight. A sandwich structure is cost-effective because the relatively low-cost core replaces more expensive composite reinforcement material and can be cured with the skins in one-shot processes like resin infusion. The stiffer but lighter sandwich panel requires less supporting structure than a solid laminate. Marine composites typically only refer to matching a high density foam with a fiberglass sheet or epoxy sheet in the wall of a boat or similar application. Further layers such as expanded polystyrene (EPS) that might be used in surfboard applications are not discussed in marine/boat applications since this added layer is unnecessary and is a surfing specific application hence marine art tends to lead away from surfboard manufacture.

For the purpose of this specification the term 'comprise' and grammatical variations thereof shall have an inclusive meaning—i.e. that it will be taken to mean an inclusion of not only the listed components it directly references, but also other non-specified components or elements.

Further aspects and advantages of the process and product will become apparent from the ensuing description that is given by way of example only.

SUMMARY

Described herein are flotation devices such as surfboards and surfboards blanks that remove the need for a stringer or stringers and yet provide greater strength an board dynamics than traditional stringer designs. The devices described utilise a central layer formed from a high density foam sandwiched between two low density foams.

In a first aspect there is provided a flotation device, including:

a top low density foam portion;

a bottom low density foam portion; and a central layer made of a high density foam sandwiched between the top foam and bottom foam portions;

at least one spine portion located along a portion of the flotation device length; and wherein the flotation device does not include a stringer or stringers.

In a second aspect there is provided a surfboard, including:

a top low density foam portion;

a bottom low density foam portion; and a central layer made of a high density structural foam sandwiched between the top foam and bottom foam portions;

a toughened outer layer coating over the exterior surface;

at least one spine portion located along a portion of the board length wherein the flotation; and wherein the surfboard does not include a stringer or stringers.

In a third aspect there is provided a surfboard blank, including:

a top low density foam portion;

a bottom low density foam portion; and a central layer made of a high density foam sandwiched between the top foam and bottom foam portions;

at least one spine portion located along a portion of the board length wherein the flotation; and wherein the surfboard blank does not include a stringer or stringers.

In a fourth aspect there is provided a method of manufacturing a flotation device blank by the steps of:

(a) preparing a sandwich structure with:

a top low density foam portion, a central portion manufactured from a high density structural foam, a bottom low density portion and a fiberglass and resin layer located between the top portion and central layer and the bottom portion and central layer and a spine portion located along a portion of the board length, the spine portion being seated on the central layer and extending from the central layer towards the surfboard deck, protruding into the top foam portion;

(b) vacuum compressing the sandwich structure;

(c) shaping the resulting sandwich structure to the desired contours thereby forming a flotation device blank.

Advantages of the above will become apparent including improved board dynamics such as greater strength yet enough flex for the desired activities. Also, the device is a durable product that is easy to manufacture, doesn't delaminate and is easy to shape and work with.

BRIEF DESCRIPTION OF THE DRAWINGS

Further aspects of the flotation device, surfboard, surfboard blank and method of manufacture will become apparent from the following description that is given by way of example only and with reference to the accompanying drawings in which.

DETAILED DESCRIPTION OF THE PREFERRED EMBODIMENT

Figure 1:
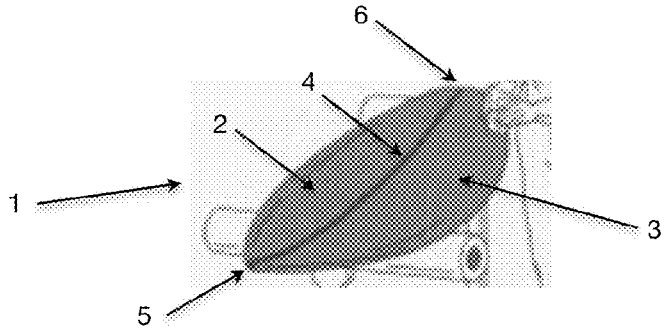
FIG. 1 illustrates a traditional surfboard configuration.

As noted above, flotation devices such as surfboards and surfboards blanks that remove the need for a stringer or stringers and yet provide greater strength and board dynamics than traditional stringer designs. The devices described utilise a central layer formed from a high density foam sandwiched between two low density foams.

For the purposes of this specification, the term 'about' or 'approximately' and grammatical variations thereof mean a quantity, level, degree, value, number, frequency, percentage, dimension, size, amount, weight or length that varies by as much as 30, 25, 20, 15, 10, 9, 8, 7, 6, 5, 4, 3, 2, or 1% to a reference quantity, level, degree, value, number, frequency, percentage, dimension, size, amount, weight or length.

The term 'substantially' or grammatical variations thereof refers to at least about 50%, for example 75%, 85%, 95% or 98%.

The term 'floatation device' or grammatical variations thereof refers to a structure or device that is capable of floating. In certain embodiments, the floatation device is an aquatic sports board such as a surfboard, windsurf board, stand up paddle board, wake board, knee board, body board, kite board, paddle board or the like.

The term 'surfboard' or grammatical variations thereof incorporates short boards, long boards, gun surfboards, fish surfboards, egg surfboards and the like and boards ranging in length from less than 4 feet long to greater than 13 feet long.

The term 'blank' or grammatical variations thereof refer to the internal structure of a floatation device or board that forms the basic structure and shape of the device or board. In surfing terms, the blank is the internal foam structure with the outer layer of for example fiberglass removed. The blank is the part of the board that is shaped to the desired contours and gives the board an overall shape.

The term 'low density foam' or grammatical variations thereof refers to a density of less than 100, or 90, or 80, or 70, or 60, or 50, or 40, or 30 kg/m$^3$.

The term 'high density foam' or grammatical variations thereof refers to a density of equal to or greater than 100, or 120, or 140, or 160, or 180, or 200 kg/m$^3$.

The term 'fibreglass' or grammatical variations thereof refers to fiberglass materials generally used in surfboard manufacture.

The term 'length' or grammatical variations thereof as used when described the floatation device or related products such as surfboards refers to the distance between the device nose and tail.

The term 'width' or grammatical variations thereof as used when described the floatation device or related products such as surfboards refers to the distance between each rail or side of the board, generally as measured about the centre of the board length or at the device or board's widest width.

The term 'height' or 'depth' or grammatical variations thereof may be used interchangeably as used when described the floatation device or related products such as surfboards refers to the distance between the device deck or top and the device base of underside, generally as measured about the centre of the board length or at the device or board's greatest height/depth.

The term 'board dynamics' refers collectively to the way the board or floatation device reacts when ridden and incorporates actions such as strength, rigidity and flex.

In a first aspect there is provided a flotation device, including:

- a top low density foam portion;
- a bottom low density foam portion; and
- a central layer made of a high density foam sandwiched between the top foam and bottom foam portions;
- at least one spine portion located along a portion of the flotation device length; and
- wherein the flotation device does not include a stringer or stringers.

Removal of a stringer is achieved using the design described yet the strength and flotation device dynamics in terms of ride and durability are maintained. An additional advantage is that, by removal of the stringer, the flotation device may be easier to shape to the desired contours as the flotation device has both a single material top or deck and bottom or underside. In addition, the variation described requires minimal materials and is easier to manufacture than a traditional stringer design flotation device.

Also of advantage is that the central layer need not have any special curvature or shaping relative to the top portion or bottom portion unlike art that requires a specific offset shape of the central section e.g. carbon fibre relative to the flotation device surface. This therefore reduces labour costs as the internal layer need not be shaped first and instead can be shaped at a later stage.

The height of the central layer may be approximately 1%, or 2%, or 3%, or 4%, or 5%, or 6%, or 7%, or 8%, or 9%, or 10%, or 15%, or 20%, or 25%, or 30% of the full height of the flotation device from the device deck to underside. As may be appreciated from this, the central layer is primarily used for strength and durability whilst the top and bottom portions are primarily used to give shape and buoyancy to the flotation device. In one embodiment, the central layer may be approximately 1 mm, or 2 mm, or 3 mm, or 4 mm, or 5 mm, or 6 mm, or 7 mm, or 8 mm, or 9 mm, or 10 mm thick and the flotation device width may typically be 10 mm, or 20 mm, or 30 mm, or 40 mm, or 50 mm, or 60 mm although variations outside this range are also encompassed. As an example, windsurfing boards tend to be thicker than surfboards and some boards are longer than other boards hence require varying rigidity, strength, flex or board dynamics as a whole.

In the above aspect a single central layer is referred to. Also encompassed are the use of two or more layers or sheets of high density foam forming a combined central layer.

The central layer may extend across the full width and length of the flotation device so that the edge of the central layer finishes flush with the top and bottom foam portions. As may be appreciated, the central layer edge or perimeter may instead finish within the boundary defined by the foam layers and their edges. In the embodiment of a reduced size central layer, the layer may be nested inside a recess or recesses in the foam portion or portions.

The thickness of the bottom foam portion may be thinner than the thickness of the top foam portion so as to offset the central layer from the flotation device centre height towards the base of the flotation device. The degree of offset from the flotation device centre width may be from 1 mm, or 2 mm, or 3 mm, or 4 mm, or 5 mm, 10 mm, 15 mm, or 20 mm, or 25 mm, or 30 mm, or 35 mm, or 40 mm, or 45 mm or 50 mm from a centre line.

The central layer may be manufactured from a single section of structural foam. As may be appreciated, the central layer could be made from multiple parts but the inventor has found it is easiest to manufacture the central layer from one piece of foam as this avoids extra material handling and ensures a continuous foam structure throughout the device length and width.

The structural foam may be a thermoset and/or thermoplastic polymer.

The structural foam may be a linear closed cell thermoplastic styrene acrylonitrile (SAN) foam. In one embodiment, the structural foam may be Corecel™ Characteristics of these types of foam that make them useful include:

(a) a high density resulting in good compression strength;
(b) environmental stability including a high tolerance for heat (for example, tolerant of temperatures from 85° C.-235° C.) and a high tolerance to chemical exposure;
(c) mechanically resilient including having a high ductility and damage tolerant;
(d) dimensioned with a fine cell size meaning the material is both lower in cost and lightweight;
(e) uniform properties with a minimal variation in density;
(f) the foam is chemically compatible particularly with all polyester, vinylester and epoxy resin curing mechanisms;
(g) the thermal expansion properties (coefficient of expansion) of the foams are consistent with glass and foams so that thermal cycling does not cause debonding.

The above foams are used in the marine industry but typically as a thin sandwich with a glass or epoxy layer on either side of the foam and no further layers. Flotation devices such as surfboards also require the addition of buoyancy layers and there is a need to bond the various parts together yet still retain desired flotation devices dynamics such as flex yet strength. As a result, marine use does not tell the full story of how this material may be used in flotation device applications and the resulting, surprisingly good dynamics plus improved or at least compatible strength.

The inventor found that the flotation device described also resolved problems in the art with delamination between layers and despite various tests completed, no delamination has been identified solving problems found in other art devices where delamination is a very real issue.

A further advantage of using high density foams to form a central core is that, were the device exterior to be damaged and the outer layer broken, moisture is not readily taken up by the internal materials as they are hydrophobic and by contrast to other materials, repel water. Fixing breakages or 'dings' as they are often called are often simple and quick to complete but can be delayed owing to the fact that the board internals need to dry first before the ding is repaired otherwise moisture may be sealed inside the board thereby changing the flotation device buoyancy and dynamics. Use of the described materials avoids or at least reduces the drying time needed before a repair may be made. Wooden stringers in particular are the most problematic for moisture uptake hence removal of a stringer altogether may be beneficial if only for this moisture retention issue.

The central layer may include a fiberglass and resin layer between the top foam portion and the central layer. The central layer may include a fiberglass and resin layer between the bottom foam portion and the central layer. Further, the central layer may include both a fiberglass and resin layer between the top foam portion and the central layer and a fiberglass and resin layer between the bottom foam portion and the central layer. The inventor has found that use of a fiberglass layer on one or both sides of the central layer helps to bond or laminate the different foams together. As noted above, the materials chosen are all compatible and do not delaminate over time.

The low density top and bottom portion foams may be closed cell foams that are primarily used for buoyancy and are non-structural. In one embodiment, the low density foam may be expanded polystyrene (EPS). The low density foam may be characterised by being buoyant and flexible up to a point and then undergo sudden failure. The low density foam may also be shaped easily by hand or by machine and gives an exterior shape to the board. The low density foam may be epoxy or fiberglass compatible. A further advantage of using EPS is that it repels water unlike polyurethane foams that tend to absorb water. This difference in moisture retention becomes very important when the exterior coating of a flotation device is damaged and the internal device structure becomes exposed to the environment. Moisture retention within the device can dramatically change the device buoyancy and dynamics. Not absorbing moisture removes this risk of device damage.

The flotation device includes a spine or spines. The spine may confer greater rigidity and strength to the flotation device. Use of the spine or spines may be helpful to alter the board dynamics desired and also to increase the degree of strength and rigidity desired.

As may be appreciated, the above described spine or spines differ to a stringer as the described spine(s) only extend along a portion of the device length and not full length as is the case with stringer designs.

In one embodiment, only one spine may be used. Further description is made in respect o a single spine however it should be appreciated that multiple spines may be used despite the singular description used.

The spine portion may be seated on the central layer and extend from the central layer towards the device deck, protruding into the top foam portion. Alternatively, the spine may be configured differently such as where the spine is fitted into an aperture in the central layer and/or the spine extends into the bottom foam section partly or entirely. Extending into the top portion is considered desirable as it may be advantageous to bias the central layer towards the base of the board as a whole hence more space is available in the top portion for the spine to be nested/enclosed.

The spine portion may be manufactured in part or in full from a high density structural foam. The structural foam used to form the spine portion may be a linear closed cell thermoplastic styrene acrylonitrile (SAN) foam. Details of this type of foam are described above.

The spine portion may be centrally located and extend along approximately 5%, or 10%, or 15%, or 20%, or 25%, or 30%, or 35%, or 40%, or 45%, or 50%, or 60%, or 70% of the overall flotation device length.

The spine portion may have a width of approximately 1%, or 2%, or 3%, or 4%, or 5%, or 6%, or 7%, or 8%, or 9%, or 10%, or 15%, or 20%, or 25% of the overall floatation device width.

The centre of the spine may be located approximate the centre of the flotation device length and width.

The spine portion may be an approximately rectangular shaped block formed as one piece. Alternatively, the spine portion may be formed in multiple pieces or formed integral with the central layer.

The spine portion may protrude into the top foam portion finishing flush with the surface of the top foam portion. The spine portion may protrude into the top foam portion and not extend to the surface of the top foam portion. As may be appreciated, hiding the spine within the top portion hides the internal structure and also allows for easier shaping as there is no change in materials on the top or deck of flotation device.

The spine portion may include a fiberglass and resin layer between the top and/or bottom foam portion or portions and the spine portion. This may help bonding the spine portion to the other parts of the flotation device in a similar manner, as the central layer may be fiberglass bonded to the foam portion(s).

The floatation device may further include a toughened hard outer layer coating over the exterior surface of the flotation device. The outer layer may be a fiberglass/resin or epoxy resin coating. The outer layer may also be a soft coating having a water proof or water resistant coating outer surface such as a cloth or other plastic covering. An outer layer may be used to give a smooth finish, to seal the internal board structure and to strengthen the floatation device. As may be appreciated though, the blank shape defines the overall floatation device shape and the outer layer follows the contours of the blank.

The flotation device may include a fin or fins integral to the blank or outer layer. Alternatively, the floatation device may instead include apertures in the blank or outer layer to fit fin systems such as FCS fins.

In one embodiment, the floatation device is a surfboard. Other floatation devices that the flotation device design may be used for include stand-up paddle (SUP) boards, windsurfing boards, kite boards, wake boards and other aquatic sports boards.

In a second aspect there is provided a surfboard, including:

a top low density foam portion;

a bottom low density foam portion; and a central layer made of a high density structural foam sandwiched between the top foam and bottom foam portions;

a toughened outer layer coating over the exterior surface;

at least one spine portion located along a portion of the board length wherein the flotation; and wherein the surfboard does not include a stringer or stringers.

In a third aspect there is provided a surfboard blank, including:

a top low density foam portion;

a bottom low density foam portion; and a central layer made of a high density foam sandwiched between the top foam and bottom foam portions;

at least one spine portion located along a portion of the board length wherein the flotation; and wherein the surfboard blank does not include a stringer or stringers.

In a fourth aspect there is provided a method of manufacturing a flotation device blank by the steps of:

(a) preparing a sandwich structure with:

a top low density foam portion, a central portion manufactured from a high density structural foam, a bottom low density portion and a fiberglass and resin layer located between the top portion and central layer and the bottom portion and central layer and a spine portion located along a portion of the board length, the spine portion being seated on the central layer and extending from the central layer towards the surfboard deck, protruding into the top foam portion;

(b) vacuum compressing the sandwich structure;

(c) shaping the resulting sandwich structure to the desired contours thereby forming a flotation device blank.

The floatation device may be a surfboard. Other floatation devices that the design may be used for include stand-up paddle (SUP) boards, windsurfing boards, kite boards, wake boards and other aquatic sports boards.

Advantages of the above will become apparent including improved board dynamics such as greater strength yet enough flex for the desired activities. Also, the device is a durable product that is easy to manufacture, doesn't delaminate and is easy to shape and work with.

The embodiments described above may also be said broadly to consist in the parts, elements and features referred to or indicated in the specification of the application, individually or collectively, and any or all combinations of any two or more said parts, elements or features, and where specific integers are mentioned herein which have known equivalents in the art to which the embodiments relates, such known equivalents are deemed to be incorporated herein as if individually set forth.

Where specific integers are mentioned herein which have known equivalents in the art to which this invention relates, such known equivalents are deemed to be incorporated herein as if individually set forth.

WORKING EXAMPLES

Example 1

Referring to FIG. 1, the process of making an art surfboard blank 1 is illustrated. The board blank 1 includes two sides 2,3 made from polyurethane (PU) foam. The two sides 2,3 are linked about the centre of the board blank 1 width by a stringer 4. The stringer 4 runs from the nose 5 of the board blank 1 to the tail 6 of the board blank 1. The stringer 4 is typically manufactured from a lightweight wood such as balsa. The blank 1 is typically glued together as shown in FIG. 1 and then shaped by hand or by machine to the desired contours. Shaping about the region of the stringer 4 can be problematic owing to the contrast in material hardness. To produce a finished surfboard form the blank 1, the blank 1 is covered in a toughened outer layer coating such as fiberglass/resin or an epoxy resin coating (not shown). The art board blank design has been used for many years as, while it is far from perfect, it represents the best compromise between weight and ease of manufacture, cost and strength. The design has also stayed this way for many years owing to a degree of inertia in the industry to change, boards shapes and designs being secretive and traditional.

Example 2

Figure 2:
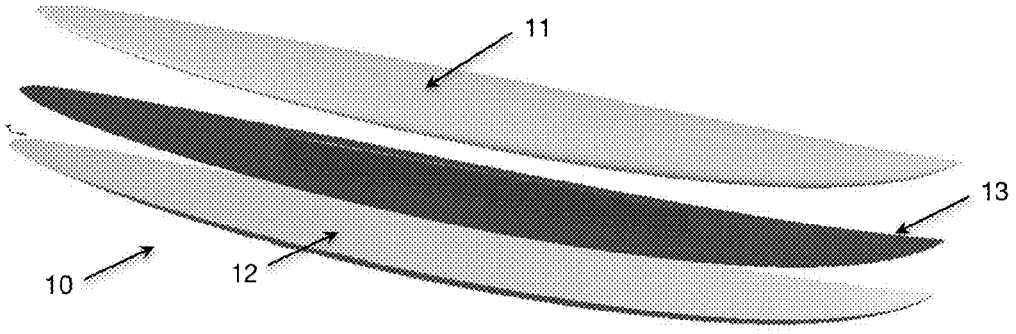
FIG. 2 illustrates a perspective view a first embodiment of a floatation device.
Figure 3:
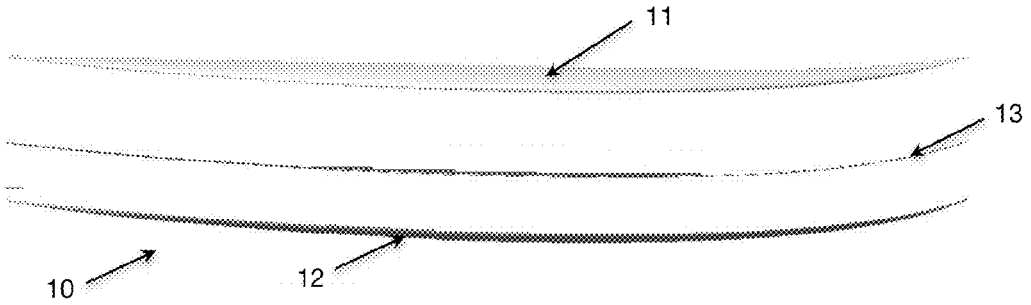
FIG. 3 illustrates an elevation view of the first embodiment.
Figure 4:
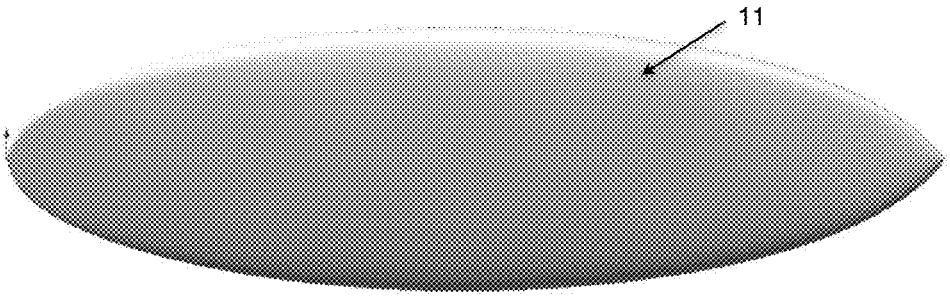
FIG. 4 illustrates a view of the top of the floatation device.

FIGS. 2 to 4 illustrate a first embodiment of a surfboard blank 10 based on the new design described herein, generally indicated by arrow 10. The surfboard 10 is illustrated as a blank without an outer coating layer (not shown) to allow viewing of the internal structure.

The board blank 10 includes a low density top foam portion 11, and low density bottom foam portion 12. The board blank 10 includes a central layer 13. The central layer 13 is manufactured from a high density structural foam sandwiched between the top foam 11 and bottom foam 12 portions. The board blank 10 does not include a stringer or stringers.

The low density top 11 and bottom 12 portion foams may be closed cell foams that are primarily used for buoyancy and are non-structural. In the embodiment shown, the low density foam used is expanded polystyrene (EPS).

The height of the central layer 13 in the embodiment shown is approximately 6 mm thick. The thickness may vary depending on the board 10 size, dynamics and strength desired.

As illustrated, the central layer 13 is made of a single piece of high density structural foam. Multiple layers of high density structural foam, which together form the central layer 13, may also be used.

As illustrated, the central layer 13 extends across the full width and length of the board blank 10 so that the edge of the central layer 13 finishes flush with the top 11 and bottom 12 foam portions. The central layer 13 edge or perimeter may instead finish within the boundary defined by the foam layers 11, 12 and their edges.

The thickness of the bottom foam portion 12 is thinner about the centre of the board blank 10 than the top foam portion 11 meaning that the central layer 13 is biased towards the base of the board blank 10.

The structural foam used to form the central layer 13 in the embodiment shown is a linear closed cell thermoplastic styrene acrylonitrile (SAN) foam.

The central layer 13 may include a fiberglass and resin layer between the top foam portion 11 and the central layer 13 (not shown) and a similar fiberglass and resin layer between the bottom foam portion 12 and the central layer 13 (not shown). A fiberglass layer on one or both sides of the central layer 13 helps to bond or laminate the different foams together.

As illustrated in FIG. 4, the top surface or deck of the board blank 10 is clean of any changes in material, being only the top foam portion 11 and the internal structure is not visible from the deck of the board blank 10.

The finished board (not shown) includes an outer layer coating (not shown) over the exterior surface of the board blank 10. The outer layer may be a hard fiberglass/resin or epoxy resin or soft cloth or other plastic covering (not shown). An outer layer may be used to give a smooth finish, to seal the board blank 10 structure and to strengthen the board blank 10.

The complete board (not shown) may include a fin or fins integral to the board blank 10 or instead, the complete board may instead include apertures in the blank 10 or outer layer (not shown) to fit fin systems such as FCS fins (not shown).

Example 3

Figure 5:
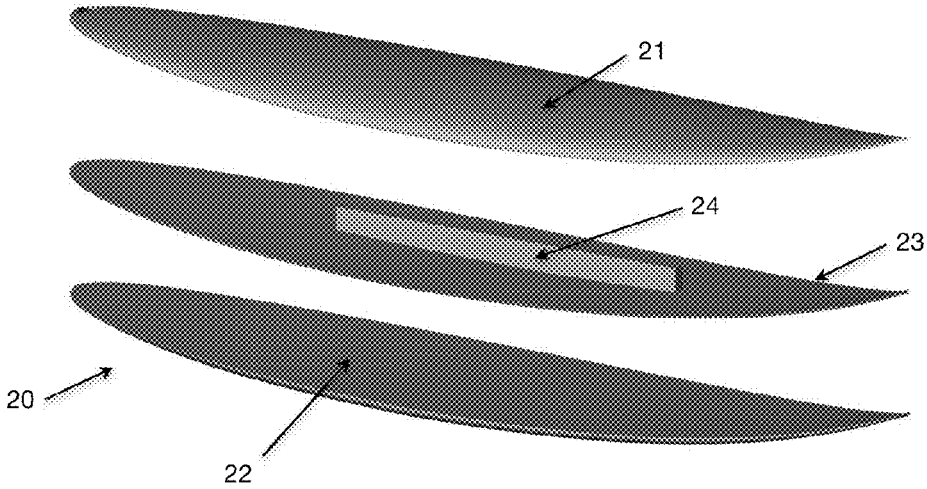
FIG. 5 illustrates a perspective view of a second embodiment of a floatation device.
Figure 6:
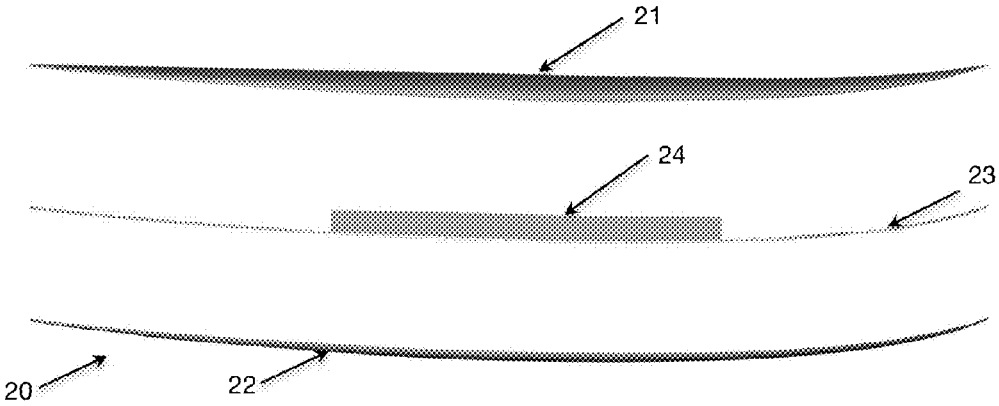
FIG. 6 illustrates an elevation view of the second embodiment.

Referring to FIGS. 5 and 6, a second embodiment of the board blank 20 is illustrated. The board blank 20 again includes a top low density foam portion 21 and a bottom low density foam portion 22 along with a central layer 23. The board blank 20 also includes a spine portion 24 located along a portion of the board 20 length.

A spine 24 may be used depending on the board blank 20 dynamics desired. A spine 24 may confer greater rigidity and strength to the board blank 20.

The spine 24 (or spines as more than one spine may be used) differ to a stringer used in traditional designs (see FIG. 1) as the described spine(s) 24 only extend along a portion of the board blank 20 length and not full length as is the case with stringer designs. Further, the spine(s) 24 as illustrated do not protrude to the surface of the board blank 20 deck (see FIG. 4) unlike traditional stringer designs that do penetrate the board blank 20 surface. It should however be appreciated that the spine could finish flush with the top portion surface. As illustrated, the spine 24 is nested/enclosed within the top foam portion 21 in the embodiment illustrated although could also be nested within the central layer 23 and/or bottom portion 22 as well if desired.

The spine 24 illustrated may be manufactured in part or in full from a high density structural foam such as a linear closed cell thermoplastic styrene acrylonitrile (SAN) foam also used for the central layer 23.

The spine 24 is in the embodiment shown a roughly rectangular block, ideally located in the centre of the board blank 20 width and length and extends along approximately 5% to 50% of the overall board blank 20 length. The spine 24 may have a width of approximately 1% to 25% of the overall floatation device width.

The spine 24 is illustrated in FIGS. 5 and 6 as a separate part to the central layer 24 but may instead be formed as an integral part of the central layer 23.

The spine 24 may include a fiberglass and resin layer (not shown) between the spine and other materials e.g. the top foam portion 21. This may be added to help bonding the spine 24 to the other parts of the board blank 20.

The finished board (not shown) includes an outer layer coating (not shown) over the exterior surface of the board blank 20. The outer layer may be a hard fiberglass/resin or epoxy resin or soft cloth or other plastic covering (not shown). An outer layer may be used to give a smooth finish, to seal the board blank 20 structure and to strengthen the board blank 20.

The complete board (not shown) may include a fin or fins integral to the board blank 20 or instead, the complete board may instead include apertures in the blank 20 or outer layer (not shown) to fit fin systems such as FCS fins (not shown).

As noted above, in the embodiments described and illustrated, reference is made to the flotation device being a surfboard or board. The design described may also be used for other aquatic board sports such as for stand-up paddle (SUP) boards, windsurfing boards, kite boards, wake boards, body boards and so on.

Aspects of the floatation device, surfboard, surfboard blank and methods of manufacture have been described by way of example only and it should be appreciated that modifications and additions may be made thereto without departing from the scope of the claims herein.

What is claimed is:

1. A flotation device, including:

a top low density foam portion;

a bottom low density foam portion; and a central layer made of a high density foam sandwiched between the top foam and bottom foam portions;

at least one spine portion located along a portion of the flotation device length; wherein the spine portion is seated on the central layer and protrudes into the top foam portion; and wherein the flotation device does not include a stringer or stringers.

2. The flotation device as claimed in claim 1 wherein the height of the central layer is approximately 1-30% of the full height of the flotation device from the device deck to underside.

3. The flotation device as claimed in claim 1 wherein the central layer extends across the full width and length of the flotation device.

4. The flotation device as claimed in claim 1 wherein the thickness of the bottom foam portion is thinner than the thickness of the top foam portion so as to position the central layer towards the base of the flotation device.

5. The flotation device as claimed in claim 1 wherein the central layer is manufactured from a single section of structural foam.

6. The flotation device as claimed in claim 1 wherein the-high density foam is a thermoset and thermoplastic polymer.

7. The flotation device as claimed in claim 1 wherein the high density foam is a linear closed cell thermoplastic styrene acrylonitrile (SAN) foam.

8. The flotation device as claimed in claim 1 wherein the central layer includes a fiberglass and resin layer between the top foam portion and the central layer.

9. The flotation device as claimed in claim 1 wherein the central layer includes a fiberglass and resin layer between the bottom foam portion and the central layer.

10. The flotation device as claimed in claim 1 wherein the spine portion is seated on the central layer and extends from the central layer into the top foam portion and ends flush with the top foam portion exterior surface.

11. The flotation device as claimed in claim 1 wherein the spine portion is manufactured from a high density foam.

12. The flotation device as claimed in claim 11 wherein the high density foam used to form the spine portion is a linear closed cell thermoplastic styrene acrylonitrile (SAN) foam.

13. The flotation device as claimed in claim 1 where in the spine portion is centrally located and extends along approximately 10 to 70% of the overall flotation device length.

14. The flotation device as claimed in claim 1 wherein the spine portion has a width of approximately 1 to 25% of the overall flotation device width.

15. The flotation device as claimed in claim 1 wherein the spine portion is an approximately rectangular shaped block.

16. The flotation device as claimed in claim 1 wherein the spine portion includes a fiberglass and resin layer between the top and/or bottom foam portion or portions and the spine portion.

17. The flotation device as claimed in claim 1 wherein the device further includes a toughened outer layer coating enclosing the top portion, bottom portion, central layer and spine portion.

18. A flotation device, including:

a top low density foam portion;

a bottom low density foam portion; and a central layer made of a high density foam sandwiched between the top foam and bottom foam portions, wherein the thickness of the bottom foam portion is thinner than the thickness of the top foam portion so as to position the central layer towards the base of the flotation device;

at least one spine portion located along a portion of the flotation device length; and wherein the flotation device does not include a stringer or stringers.

19. The flotation device as claimed in claim 18 wherein the spine portion protrudes into the top foam portion.

20. The flotation device as claimed in claim 18, wherein the height of the central layer is approximately 1-30% of the full height of the flotation device from the device deck to underside.

21. The flotation device as claimed in claim 18, wherein the central layer extends across the full width and length of the flotation device.

22. The flotation device as claimed in claim 18, wherein the central layer is manufactured from a single section of structural foam.

23. The flotation device as claimed in claim 18, wherein the central layer includes a fibreglass and resin layer between the top foam portion and the central layer.

24. The flotation device as claimed in claim 18, wherein the central layer includes a fibreglass and resin layer between the bottom foam portion and the central layer.

25. The flotation device as claimed in claim 18, wherein the spine portion is seated on the central layer and extends from the central layer into the top foam portion and ends flush with the top foam portion exterior surface.

26. The flotation device as claimed in claim 18, wherein the spine portion is manufactured from a high density foam.

27. The flotation device as claimed in claim 26, wherein the high density foam used to form the spine portion is a linear closed cell thermoplastic styrene acrylonitrile (SAN) foam.

28. The flotation device as claimed in claim 18, where in the spine portion is centrally located and extends along approximately 10 to 70% of the overall flotation device length.

29. The flotation device as claimed in claim 18, wherein the spine portion has a width of approximately 1 to 25% of the overall flotation device width.

30. The flotation device as claimed in claim 18, wherein the spine portion is an approximately rectangular shaped block.

31. The flotation device as claimed in claim 18, wherein the spine portion includes a fibreglass and resin layer between the top and/or bottom foam portion or portions and the spine portion.

32. The flotation device as claimed in claim 18, wherein the device further includes a toughened outer layer coating enclosing the top portion, bottom portion, central layer and spine portion.

33. A flotation device, including:

a top low density foam portion;

a bottom low density foam portion; and a central layer made of a high density foam sandwiched between the top foam and bottom foam portions, wherein the thickness of the bottom foam portion is thinner than the thickness of the top foam portion so as to position the central layer towards the base of the flotation device;

at least one spine portion located along a portion of the flotation device length, wherein the spine portion includes a fibreglass and resin layer between the top and/or bottom foam portion or portions and the spine portion; and wherein the flotation device does not include a stringer or stringers.

34. The flotation device as claimed in claim 33, wherein the high density foam is a thermoset and thermoplastic polymer.

35. The flotation device as claimed in claim 33, wherein the high density foam is a linear closed cell thermoplastic styrene acrylonitrile (SAN) foam.

36. The flotation device as claimed in claim 33, wherein the spine portion protrudes into the top foam portion.

* * * * *